US006325541B1

(12) United States Patent
Thrall et al.

(10) Patent No.: US 6,325,541 B1
(45) Date of Patent: Dec. 4, 2001

(54) RESEALABLE CLOSURE FOR A BAG

(75) Inventors: Ronald G. Thrall, Vancouver, WA (US); James M. Freeman; Wayne C. Piper, both of Omaha, NE (US)

(73) Assignee: Bemis Company, Inc., Minneapolis, MN (US)

( * ) Notice: Subject to any disclaimer, the term of this patent is extended or adjusted under 35 U.S.C. 154(b) by 0 days.

(21) Appl. No.: 09/492,919

(22) Filed: Jan. 27, 2000

Related U.S. Application Data

(62) Division of application No. 09/265,688, filed on Mar. 10, 1999, now Pat. No. 6,048,100.

(51) Int. Cl.[7] ..... B65D 33/18

(52) U.S. Cl. ..... 383/203; 383/86; 383/205; 428/40.1; 428/352

(58) Field of Search ..... 428/40.1, 352; 383/210, 211, 62, 89, 203, 205, 86

(56) References Cited

U.S. PATENT DOCUMENTS

| | | | | |
|---|---|---|---|---|
| 2,998,911 | | 9/1961 | Hahn et al. . | |
| 3,081,930 | | 3/1963 | Owens . | |
| 3,565,328 | | 2/1971 | Hudson . | |
| 3,648,922 | | 3/1972 | Gebo . | |
| 3,827,625 | * | 8/1974 | Miller | 383/211 |
| 4,441,613 | | 4/1984 | Hain et al. . | |
| 4,460,091 | | 7/1984 | Hain et al. . | |
| 4,480,752 | | 11/1984 | Jacobs . | |
| 4,512,479 | | 4/1985 | Hain et al. . | |
| 4,515,273 | | 5/1985 | Jacobson et al. . | |
| 4,552,269 | | 11/1985 | Chang . | |
| 4,567,987 | | 2/1986 | Lepisto et al. . | |
| 4,584,217 | * | 4/1986 | McClintock | 428/40.1 |
| 4,610,651 | | 9/1986 | Jacobson et al. . | |
| 4,616,470 | | 10/1986 | Nakamura . | |
| 4,651,874 | | 3/1987 | Nakamura . | |
| 4,653,250 | | 3/1987 | Nakamara . | |
| 4,690,322 | * | 9/1987 | Burns | 383/211 X |
| 4,739,879 | | 4/1988 | Nakamura . | |
| 4,840,270 | | 6/1989 | Caputo et al. . | |
| 4,911,563 | * | 3/1990 | Ciani | 383/89 |
| 5,048,718 | | 9/1991 | Nakamura . | |
| 5,141,793 | * | 8/1992 | Fontanilla | 428/40.1 X |
| 5,427,849 | * | 6/1995 | McClintock | 428/40.1 X |
| 5,582,342 | | 12/1996 | Jud . | |
| 5,616,385 | * | 4/1997 | Rothrum et al. | 428/40.1 |
| 5,855,434 | * | 1/1999 | Hagen | 383/62 X |
| 5,888,335 | * | 3/1999 | Kobe et al. | 156/306.3 |
| 6,048,100 | * | 4/2000 | Thrall et al. | 383/203 X |
| 6,068,403 | * | 5/2000 | Schneck | 383/211 X |
| 6,120,184 | * | 9/2000 | Laurence et al. | 383/203 X |

* cited by examiner

*Primary Examiner*—Jes F. Pascua
(74) *Attorney, Agent, or Firm*—Lee, Mann, Smith, McWilliams, Sweeney & Ohlson

(57) ABSTRACT

A resealable closure for a bag is described wherein the bag has upper and lower ends and including a front wall member, a back wall member, and opposite side wall members. The lower end of the bag is sealed in conventional fashion. The upper ends of the wall members are folded downwardly adjacent the front wall member to form a flap which extends across the upper end of the bag with the upper flap being permanently sealed, by an adhesive, to the front wall member except for a flap portion adjacent one of the side wall members. The resealable closure is positioned between the flap portion and the front wall of the bag and permits the flap portion to be opened to form a pour opening in the upper comer of the bag. The flap portion may be resealed by the resealable closure. The closure is designed so that the contents of the bag will not come into contact with any sticky or tacky surface as the material is being poured from the bag.

6 Claims, 3 Drawing Sheets

RESEALABLE CLOSURE FOR A BAG

REFERENCE TO OTHER APPLICATION

This application is a divisional application of U.S. Ser. No. 09/265,688, filed Mar. 10, 1999, now U.S. Pat. No. 6,048,100.

BACKGROUND OF THE INVENTION

1. Field of the Invention

This invention relates to a bag for containing a variety of particulate materials such as dog food, cat food, etc. More particularly, the invention relates to a resealable closure for a bag.

2. Description of the Related Art

Many types of bags have been previously designed for containing particulate materials such as dog food, cat food, etc. Normally, the bags for cat and dog food range in size from one pound bags to fifty pound bags. The conventional bags norrnally have a front wall member, a back wall member and opposite side wall members, with each of the wall members having upper and lower ends. Normally, the lower ends of the wall members are folded upwardly to form a flap which is sealed to either the back wall member or the front wall member to close the lower end of the bag. The upper end of the bag is also normally closed by folding the upper ends of the wall members downwardly to create a flap which is sealed to either the front wall member or the back wall member. When it is desired to pour the contents from the conventional bag, the upper flap is usually tom open, or a comer of the bag is ripped open, to enable a portion of the contents to be dispensed or poured therefrom. It is then difficult to reseal or reclose the bag after a portion of the contents has been poured therefrom.

SUMMARY OF THE INVENTION

A resealable closure for a bag is described wherein the bag has upper and lower ends with the bag including a front wall member having opposite side edges, a back wall member having opposite side edges, and side wall members extending between the side edges of the front and back wall members. When the bag is initially fabricated, the side wall members are folded inwardly between the front and rear wall members. The lower ends of the wall members are folded to form a lower flap which is sealed to either the front wall member or the back wall member to dose the lower end of the bag. The upper ends of the wall members are folded downwardly adjacent the front wall member to form a flap which extends across the upper end of the bag. The upper flap is permanently sealed, by an adhesive, to the front wall member except for a gap portion adjacent one of the side wall members. The flap portion is selectively movable between open and closed positions. The flap portion, when moved to its open position, creates a pour opening in the upper end of the bag adjacent the one side wall member to enable material in the bag to be poured therefrom through the pour opening. A resealable closure having an upper end, a lower end, opposite side edges, a front portion and a back portion is provided and has its upper front end adhesively secured to the back wall member in the unsealed flap portion with the upper end of the closure being positioned between the back wall member in the flap portion and the front wall member. The closure is selectively movable between an unsealed open position and a sealed closed position. The closure, when initially fabricated, is provided with a first release liner at its back portion which is adhesively secured, by a first adhesive, to a polyester sheet member having a second adhesive on its back surface which is initially covered with a second release liner which is removed prior to the closure being secured to the bag. The polyester sheet member and the first adhesive thereon remains on the front wall member when the closure and the flap portion are moved form their closed position to their open position. The first release liner is comprised of a non-stick material so that the material being poured from the bag will not adhere thereto. The first adhesive will not come into contact with the material being poured from the bag, since it is positioned on the front wall member and is not in the flow path of the material being poured from the bag.

It is therefore a principal object of the invention to provide an improved resealable closure for a bag.

Yet another object of the invention is to provide a bag including a resealable closure which may be opened to form a pour opening in one of the comers of the bag with the closure being designed so that the material being poured from the bag will not adhere to any sticky or tacky surface associated with the resealable closure.

Still another object of the invention is to provide a novel closure for a resealable bag.

Yet another object of the invention is to provide a bag having a resealable closure which is economical of manufacture and refined in appearance.

These and other objects will be apparent to those skilled in the art.

DESCRIPTION OF THE PREFERRED EMBODIMENT

Figure 1:
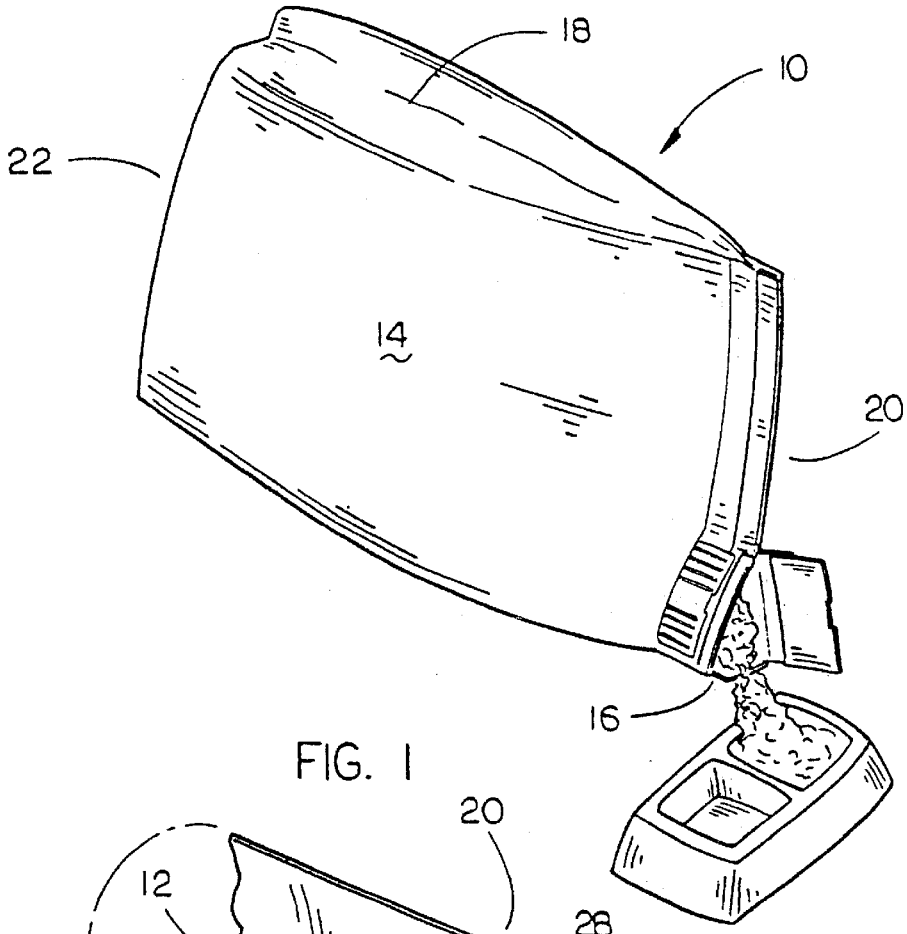
FIG. 1 is a perspective view illustrating material being poured from a bag having the resealable closure of this invention associated therewith.
Figure 2:
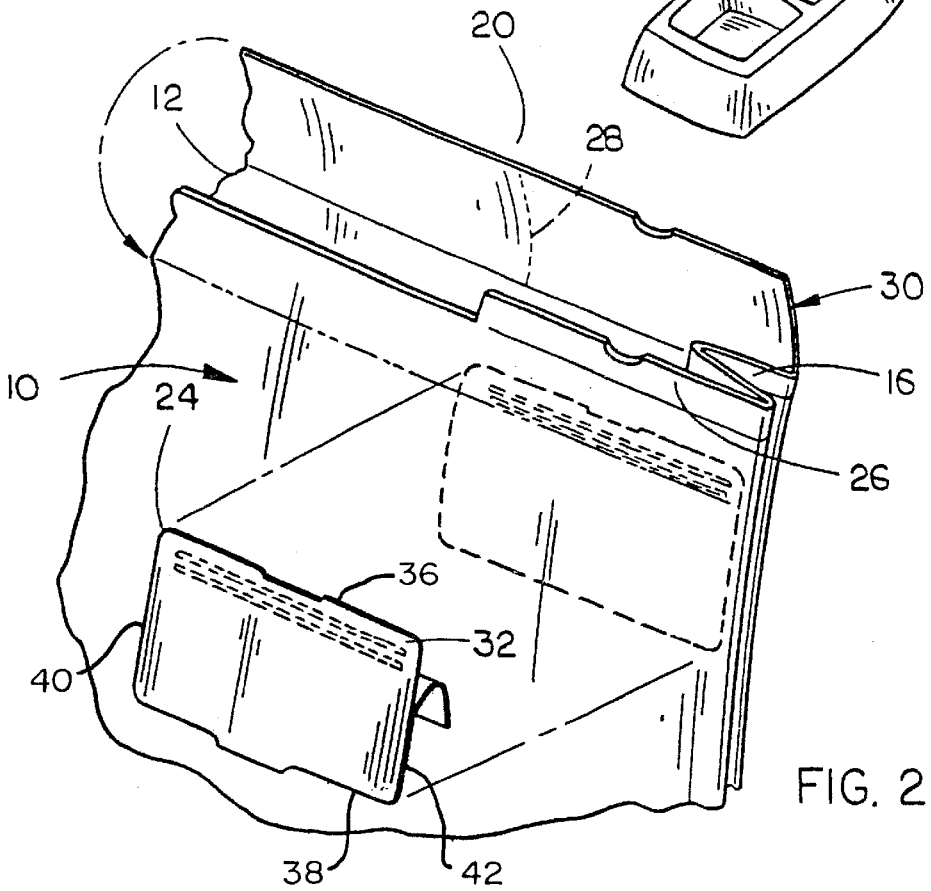
FIG. 2 is a perspective view illustrating the manner in which the resealable closure is positioned on the bag.

The numeral 10 refers to a bag for dog food, cat food, or other particulate material which includes a back wall 12, a front wall 14, and a pair of expandable (foldable) side walls 16 and 18 which extend between walls 12 and 14, as illustrated in the drawings. For purposes of description, bag 10 will be described as having an upper end 20 and a lower end 22. In most cases, the bag 10 is comprised of a plurality of layers of paper and/or polyester. Further, in conventional bags, the lower end of the bag is sealed, usually by folding the lower ends of the front wall, back wall, and side walls upon themselves to form a flap which is glued or sealed to the lower end of the back wall 12. The lower end of the front wall usually terminates slightly below the lower ends of the side wall members and the back wall for sealing purposes. Normally, the upper end of the front wall. 14 and the upper ends of the side walls terminate below the upper end of back wall 12 for conventional sealing purposes. The upper end of the conventional bag is normally sealed by folding the upper ends of the back wall 12, front wall 14, and the side walls 16 and 18 upon themselves to form a flap which is positioned adjacent at the upper end of the front wall.

The resealable closure of this invention is referred to generally by the reference numeral 24 and is designed to be used with a conventional bag, as previously described, except that the flap 26 formed at the upper end of the bag 10 is preferably perforated at 28 to define a flap portion 30, as will be described in more detail hereinafter. Flap 26, except for flap portion 30, is preferably glued to front wall 14 in conventional fashion. A glue line 32 is provided on the inside surface of the upper end of back wall 12 in flap portion 30 to enable closure 24 to be glued thereto, as will be described hereinafter. Although the closure 24 is illustrated as being positioned at the upper end of the bag, closure 24 could be provided at desired.

Closure 24 is generally rectangular in shape, although it is possible that other shapes could also be utilized. Closure 24 includes a sheet member 34 having an upper end 36, lower end 38, opposite side edges 40 and 42, front surface 44 and back surface 46. Preferably, sheet member 34 is comprised of an 80 lb. semigloss, coated one-side bleached kraft face paper stock. A possible alternative to the construction of sheet member 34 could be various weights in both a coated one or two-side beached kraft paper face stock. Sheet member 34 could also be comprised of an uncoated litho kraft stock in the same weights.

The back surface 46 of sheet member 34 is secured to a release liner 48 by an adhesive 50. Preferably, release liner 48 is comprised of a 1.42 mil polyester material. Release liner 48 could have a thickness varying from 1.0 to 2.0 mils and could be manufactured from a polypropylene or polystyrene film or blend thereof. Adhesive 50 is preferably a hot melt rubber-based adhesive which adhesively secures sheet member 34 to release liner 48. Adhesive 50 could be comprised of an acrylic or solvent-based adhesive, if so desired.

Figure 5:
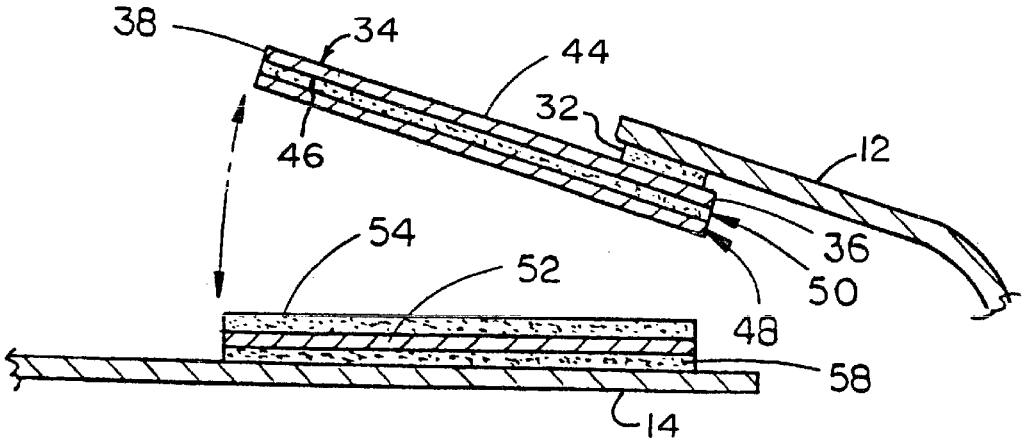
FIG. 5 is a view similar to FIG. 4, but which illustrates the manner in which the closure operates to permit the flap portion to be opened.
Figure 7:
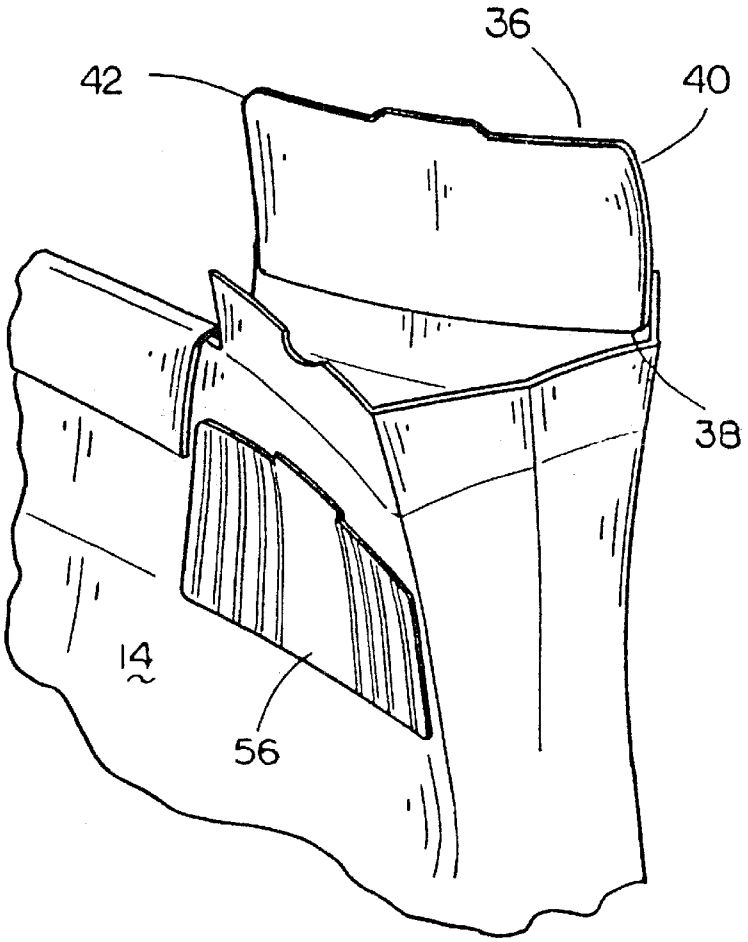
FIG. 7 is a view similar to FIG. 6 except that the flap portion has been opened to create a pour opening in the bag.
Figure 6:
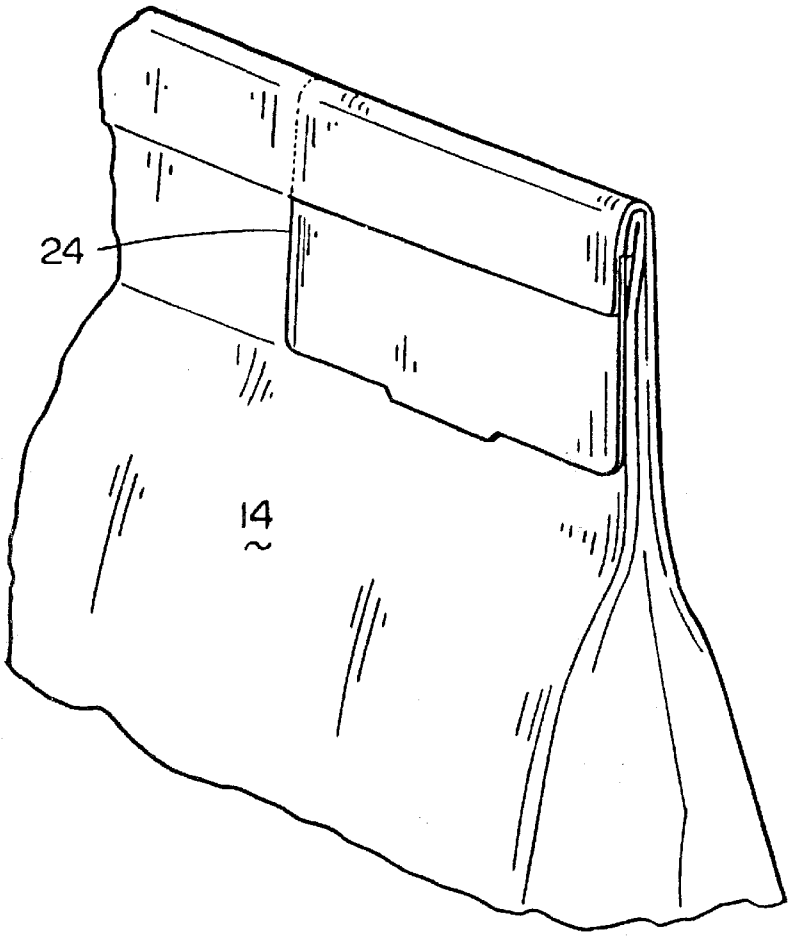
FIG. 6 is a partial perspective view illustrating the bag in its initial dosed and sealed position.

The back surface of release liner 48 is adhesively secured to sheet member 52 by adhesive 54. Preferably, sheet member 52 is comprised of a 2.0 mil polyester film. The thickness of sheet member 52 could vary in thickness from 1.0 to 2.0 mils and could be constructed of a polypropylene or polystyrene film or blend thereof. Adhesive 54 is preferably a hot melt rubber-based adhesive which temporarily holds release liner 48 to sheet member 52. Adhesive 54 is patterned in lines or strips to allow easy removal of release liner 48 therefrom while having good aggressive reseal capabilities. Adhesive 54 is provided with a deadened area 56 to allow easy gripping of the layers of material thereabove, as viewed in FIG. 5, for removal. Adhesive 54 could also be comprised of an acrylic or solvent-based adhesive if so desired. The deadened area or areas 56 could be provided at the lower comers of the closure or other locations if so desired. Further, one or more flaps without adhesive could extend from closure 24 to facilitate the closure being moved from its sealed closed position to its unsealed open position.

Figure 3:
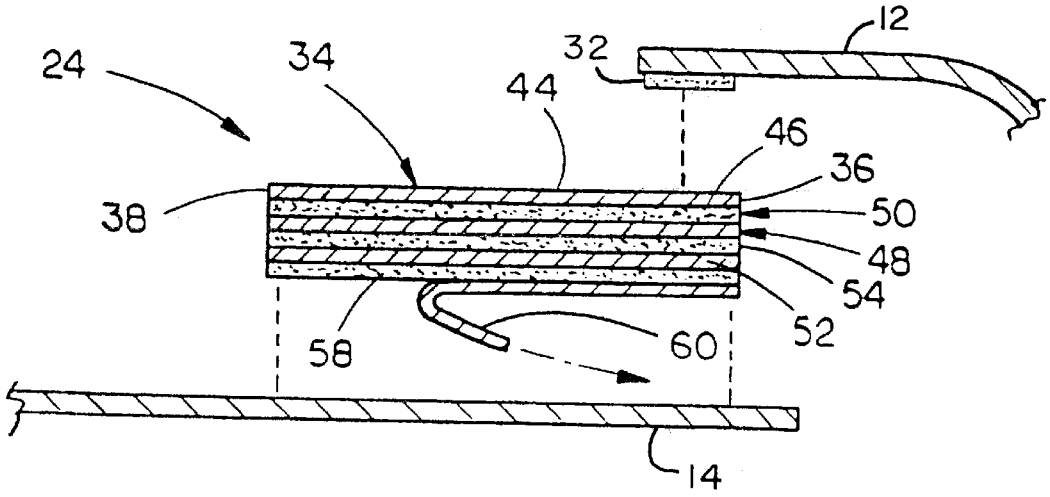
FIG. 3 is an exaggerated sectional view illustrating the manner in which the closure is initially positioned between the front wall member of the bag and the flap portion of the upper flap of the bag.
Figure 4:
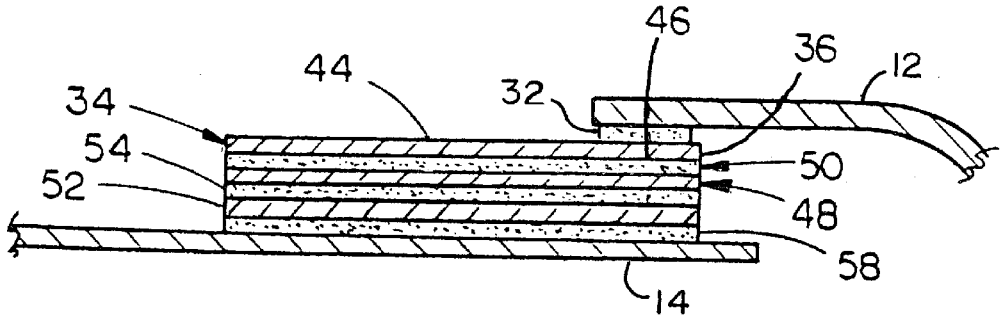
FIG. 4 is a view similar to FIG. 3 except that the flap portion has been secured to the front wall member of the bag by means of the closure of this invention.

The back surface of sheet member 52 (the bottom surface of sheet member 52 as viewed in FIGS. 3–5) has an adhesive 58 thereon which is preferably comprised of a hot melt rubber-based adhesive. Adhesive 58 could also be comprised of an acrylic or solvent-based adhesive. The numeral 60 refers to a release liner which is adhered to the adhesive 58 during fabrication of the closure 24. When the closure 24 is to be secured to the bag 10, the release liner 60 is removed and discarded. Release liner 60 is preferably comprised of a 40 lb. bleached kraft stock material.

Set forth hereinbelow are the specifications for the various components of the closure 24:

| | PREFERRED |
|---|---|
| SHEET MEMBER 34 | |
| 80# semi-gloss, coated one side | 80# |
| Caliper (mils) | 4.8 |
| Tear, MD (grams) | 83 |
| Tear, CD (grams) | 91 |
| Tensile, MD (lbs/in.) | 46 |
| Tensile, CD (lbs/in.) | 22 |
| ADHESIVE 50 | |
| A106 (General Purpose Permanent) | 10 ± 2 |
| Coating weight (lbs/3000 $FT^2$) | |
| Min. application temp. (° F.) | +40 |
| Service temp. (° F.) | −50 to +150 |
| FDA conformance | 175.105 |
| RELEASE LINER 48 | |
| Clear polyester liner | 1.5 |
| Caliper (mils) | |
| ADHESIVE 54 | |
| A301 | 15 ± 2 |
| Coating weight (lbs/3000 $FT^2$) | |
| Min. application temp. (° F.) | +40 |
| Service temp. (° F.) | −50 to +150 |
| FDA conformance | 175.105 |
| SHEET MEMBER 52 | |
| Clear polyester | 2.0 |
| Caliper (mils) | |
| Tensile, MD (PSI) | 30000 |
| Elongated MD (%) | 130 |
| Elongation at break CD (%) | 50 |
| ADHESIVE 58 | |
| A106 (General Purpose Permanent) | 13 ± 2 |
| Coating weight (lbs/3000 $FT^2$) | |
| Min. application temp. (° F.) | +40 |
| Service temp. (° F.) | −50 to +150 |
| FDA conformance | 175.105 |
| RELEASE LINER 60 | |
| 40# CIS (L2) | 42 |
| Basis weight (lbs/24 × 36 − 500) | |
| Caliper (mils) | 2.5 |
| Tear, MD (grams) | 34 |
| Tear, MD (grams) | 40 |
| Tensile, MD (lbs/in.) | 31 |
| Tensile, MD (lbs/in.) | 14 |

Closure 24 is installed on the bag 10 during the manufacture thereof and usually before the bag has been filled with the particulate material. Flap 26 is held in place by an adhesive in conventional fashion. Glue line 52 adhesively secures the inside surface of the upper end of back wall 12 to the upper end of front surface 44 of sheet member 34. Sheet member 52 of the closure 24 is secured to the front wall 14 of bag 10 by the adhesive 58. Release liner 48 of closure 10 is releasably secured to sheet member 52 by the adhesive strips 54. Thus, closure 10 initially seals the flap portion 30 to the front wall 14.

When it is desired to pour some of the contents of the bag 10 therefrom, the closure 24 is grasped at the deadened areas and pulled outwardly and upwardly from the bag 10 which causes flap portion 30 to separate from flap 26 at the perforated line 28 to form a pour opening at the upper end of the bag 10 adjacent side wall 16.

As upward and outward force is applied to the closure 24 during the opening process, release liner 48 separates from the adhesive strips 54 which remain on the sheet member 52 which is adhesively secured to front wall 14. The release liner 48 separates from adhesive 54 inasmuch as the binding adhesive strength between release liner 48 and adhesive 54 is less than the binding adhesive strength between adhesive 54 and sheet member 52 and less than the binding adhesive strength of the adhesive strength of the adhesive 58 which secures sheet member 52 to bag 10. During the opening process, sheet member 34 does not separate from release liner 48, since the binding adhesive strength of adhesive 50 is greater than the force required to separate release liner 48 from adhesive 54.

When the closure 24 has been opened to form the pour opening, the material being poured from the bag 10 will not stick or adhere to the closure 24, since the only portion of the closure 24 which comes into contact with the material is the release liner 48 which is not sticky or tacky. The material does not come into contact with the adhesive 54, since it remains on the front wall 14 of bag 10 below the pour opening.

The bag 10 may then be resealed by simply bringing the release liner 48 into engagement with the adhesive 54 which closes the do sure and the flap portion 30.

Thus it can be seen that the invention accomplishes at least all of its stated objectives.

We claim:

1. A resealable closure for opening and closing of a bag flap portion relative to a bag surface providing an external adhesive-covering release liner removably secured to an adhesive for mounting the closure on the bag surface, said closure requiring only the removal of the external adhesive-covering release liner to secure the closure to the bag surface, and, comprising:

a first sheet member having an upper end, a lower end, and opposite side edges, a front surface, and a back surface;

a non-tacky, non-adhesive first release liner, having front and back surfaces, at the back surface of said first sheet member and non-removably secured thereto by a first adhesive;

a second sheet member, having front and back surfaces, at the back surface of said first release liner and being releasably secured thereto by a tacky second adhesive wherein said second adhesive comprises a plurality of adhesive strips;

said first release liner and tacky second adhesive capable of being repetitively releasable and re-securable directly to each other to reclose the bag and having no part of the bag flap portion therebetween;

said first sheet member and second sheet member being fully separable to facilitate the opening of the bag; and the external adhesive-covering release liner being a second release liner, having front and back surfaces, at the back surface of said second sheet member and removably secured thereto by a third adhesive, said second release liner being removable to expose said third adhesive and said third adhesive adapted to permanently secure the resealable closure to the bag surface.

2. The resealable closure of claim 1 wherein said third adhesive has a greater adhesive strength than said second adhesive.

3. The resealable closure of claim 1 wherein said third adhesive has a greater adhesive strength than said first adhesive and has a greater adhesive strength than said second adhesive.

4. The resealable closure as in claim 1 wherein the plurality of adhesive strips are parallel to each other and to the opposite side edges of the first sheet member.

5. The resealable closure as in claim 4 wherein the plurality of adhesive strips include a deadened area.

6. A multi-laminate resealable closure bonded on one side to a moveable opening portion of a container, the resealable closure having at least one lamina thereof moveable with said moveable opening portion and at a second side of the closure at least one other lamina bonded to another portion of a container to which the moveable opening portion is moveable relative thereto, said multi-laminate resealable closure comprising:

a first sheet member having a front surface and a back surface;

a non-tacky first release liner having front and back surfaces and being arranged at the back surface of said first sheet member and non-removably secured thereto by a first adhesive;

a second sheet member, having front and back surfaces, arranged at the back surface of said first release liner and being releasably secured thereto by a tacky second adhesive;

said first release liner and tacky second adhesive capable of being repetitively releasable and resecurable to each other wherein the moveable portion of the container is moveable from a closed position, whereat the first sheet member and second sheet member are secured together, to an open position, whereat the first sheet member and second sheet member are separated, said first release liner and tacky second adhesive capable of being resecured to each other having no part of the moveable portion of the container therebetween;

said first sheet member and second sheet member being fully separable; and, said second sheet member having a third adhesive on said back surface thereof securing the second sheet member to said other portion of the container.

* * * * *